US011200906B2

(12) United States Patent
Lee et al.

(10) Patent No.: US 11,200,906 B2
(45) Date of Patent: Dec. 14, 2021

(54) AUDIO ENCODING METHOD, TO WHICH BRIR/RIR PARAMETERIZATION IS APPLIED, AND METHOD AND DEVICE FOR REPRODUCING AUDIO BY USING PARAMETERIZED BRIR/RIR INFORMATION

(71) Applicant: LG ELECTRONICS INC., Seoul (KR)

(72) Inventors: Tung Chin Lee, Seoul (KR); Sejin Oh, Seoul (KR)

(73) Assignee: LG ELECTRONICS, INC., Seoul (KR)

( * ) Notice: Subject to any disclaimer, the term of this patent is extended or adjusted under 35 U.S.C. 154(b) by 0 days.

(21) Appl. No.: 16/644,416

(22) PCT Filed: Nov. 14, 2017

(86) PCT No.: PCT/KR2017/012885

§ 371 (c)(1),
(2) Date: Mar. 4, 2020

(87) PCT Pub. No.: WO2019/054559

PCT Pub. Date: Mar. 21, 2019

(65) Prior Publication Data

US 2020/0388291 A1 Dec. 10, 2020

Related U.S. Application Data

(60) Provisional application No. 62/558,865, filed on Sep. 15, 2017.

(51) Int. Cl.
*G10L 19/008* (2013.01)
*G10L 19/16* (2013.01)
(Continued)

(52) U.S. Cl.
CPC ..... *G10L 19/008* (2013.01); *G10L 19/16* (2013.01); *H04S 3/008* (2013.01); *H04S 2420/01* (2013.01)

(58) Field of Classification Search
CPC ..... G10L 19/008; G10L 19/16; G10L 25/03; G10L 25/00; H04S 3/008; H04S 7/305;
(Continued)

(56) References Cited

U.S. PATENT DOCUMENTS

2014/0355795 A1* 12/2014 Xiang ..... G10L 19/008 381/303
2015/0030160 A1 1/2015 Lee et al.
(Continued)

FOREIGN PATENT DOCUMENTS

KR 1020160015269 A 2/2016
KR 1020160052575 A 5/2016

*Primary Examiner* — Leshui Zhang
(74) *Attorney, Agent, or Firm* — Dentons US LLP

(57) ABSTRACT

Disclosed are an audio encoding method, to which BRIR/RIR parameterization is applied, and a method and device for reproducing audio by using parameterized BRIR/RIR information. The audio encoding method according to the present invention comprises the steps of: when an input audio signal is a binaural room impulse response (BRIR), dividing the input audio signal into a room impulse response (RIR) and a head-related impulse response (HRIR); applying a mixing time to the divided RIR or an RIR, which is input without division when the audio signal is the RIR, and dividing the mixing time-applied RIR into a direct/early reflection part and a late reverberation part; parameterizing a direct part characteristic on the basis of the divided direct/early reflection part; parameterizing an early reflection part characteristic on the basis of the divided direct/early reflection part; parameterizing a late reverberation part characteristic on the basis of the divided late reverberation part; and when the input audio signal is the BRIR, adding the
(Continued)

divided HRIR and information of the parameterized RIR characteristic to an audio bitstream, and transmitting the same.

16 Claims, 16 Drawing Sheets

(51) Int. Cl.
*H04S 3/00* (2006.01)
*H04S 7/00* (2006.01)
*G10L 25/03* (2013.01)

(58) Field of Classification Search
CPC ..... H04S 7/306; H04S 2420/01; H04S 3/00; H04S 7/30; H04S 2420/00
USPC ..... 704/272, 278, 500, 501, 504; 381/1–23
See application file for complete search history.

(56) References Cited

U.S. PATENT DOCUMENTS

| | | | | |
|---|---|---|---|---|
| 2015/0350801 | A1* | 12/2015 | Koppens ..... | H04S 1/007 381/1 |
| 2016/0134988 | A1 | 5/2016 | Gorzel et al. | |
| 2017/0243597 | A1 | 8/2017 | Braasch | |

* cited by examiner

AUDIO ENCODING METHOD, TO WHICH BRIR/RIR PARAMETERIZATION IS APPLIED, AND METHOD AND DEVICE FOR REPRODUCING AUDIO BY USING PARAMETERIZED BRIR/RIR INFORMATION

CROSS REFERENCE TO RELATED APPLICATIONS

This application is a National Phase application of International Application No. PCT/KR2017/012885, filed Nov. 14, 2017, and claims the benefit of U.S. Provisional Application No. 62/558,865 filed on Sep. 15, 2017, all of which are hereby incorporated by reference in their entirety for all purposes as if fully set forth herein.

TECHNICAL FIELD

The present disclosure relates to an audio reproduction method and an audio reproducing apparatus using the same. More particularly, the present disclosure relates to an audio encoding method employing a parameterization of a Binaural Room Impulse Response (BRIR) or Room Impulse Response (RIR) characteristic and an audio reproducing method and apparatus using the parameterized BRIR/RIR information.

BACKGROUND ART

Recently, various smart devices have been developed in accordance with the development of IT technology. In particular, such a smart device basically provides an audio output having a variety of effects. In particular, in a virtual reality environment or a three-dimensional audio environment, various methods are being attempted for more realistic audio outputs. In this regard, MPEG-H has been developed as new audio coding international standard techniques. MPEG AVC-H is a new international standardization project for immersive multimedia services using ultra-high resolution large screen displays (e.g., 100 inches or more) and ultra-multi-channel audio systems (e.g., 10.2 channels, 22.2 channels, etc.). In particular, in the MPEG-H standardization project, a sub-group named "MPEG-H 3D Audio AhG (Adhoc Group)" is established and working in an effort to implement an ultra-multi-channel audio system.

An MPEG-H 3D Audio encoder provides realistic audio to a listener using a multi-channel speaker system. In addition, in a headphone environment, such an encoder provides a highly realistic three-dimensional audio effect. This feature allows the MPEG-H 3D Audio encoder to be considered as a VR audio standard.

In this regard, if VR audio is reproduced through a headphone, a Binaural Room Impulse Response (BRIR) or a Head-Related Transfer Function (HRTF) and a Room Impulse Response (RIR), in which space and direction sense informations are included, should be applied to an output signal. The Head-Related Transfer Function (HRTF) may be obtained from a Head-Related Impulse Response (HRIR). Hereinafter, the present disclosure intends to use HRIR instead of HRTF.

In the VR audio proceeding as the next generation audio standard, it is likely to be designed on the basis of the MPEGH 3D Audio that has been previously standardized. However, since the corresponding encoder supports only up to 3-Degree-of-Freedom (3DOF), there is a need to additionally apply related metadata and the like to support up to 6-Degree-of-Freedom (6DoF), and MPEG is considering a method for transmitting related information from a transmitting end.

Proposed in the present disclosure is a method of efficiently transmitting BRIR or RIR information, which is the most important information for headphone-based VR audio reproduction, from a transmitting end. Considering an existing MPEG-H 3D Audio encoder, 44 (=22*2) BRIRs are used to support maximum 22 channels despite a 3DoF environment. Hence, as more BRIRs are required in consideration of 6DoF, compression for each response is inevitable for a transmission in a better channel environment. The present disclosure intends to propose a method of transmitting dominant components by analyzing a feature of each response and parameterizing the dominant components only instead of compressing and transmitting a response signal compressed using an existing compression algorithm.

Particularly, in a headphone environment, a BRIR/RIR is one of the most important factors in reproducing a VR audio. Hence, total VR audio performance is greatly affected according to the accuracy of the BRIR/RIR. Yet, in case of transmitting corresponding information from an encoder, since the corresponding information should be transmitted at a bit rate as low as possible due to the limited channel bandwidth problem, bit(s) occupied by each BRIR/RIR should be as small as possible. Furthermore, in case of considering a 6DoF environment, since much more BRISs/RIRs are transmitted, bit(s) occupied by each response is more restrictive. The present disclosure proposes a method of effectively lowering a bit rate by parametrizing and transmitting dominant informations in a manner of separating a corresponding response according to a feature of a BRIR/RIR to be transmitted and then analyzing characteristics of the separated respective responses.

The following description is made in detail with reference to FIG. 1. Generally, a room response shape is shown in FIG. 1. It is mainly divided into a direct part 10, an early reflection prat 20 and a late reverberation part 30. The direct part 10 is related to articulation of a sound source, and the early reflection part 20 and the late reverberation part 30 are related to a space sense and a reverberation sense. Thus, as the characteristics of the respective parts constituting an RIR are different, featuring a response separately is more effective. In the present disclosure, a method of analyzing and synthesizing BRIR/RIR responses usable for VR audio implementation is described. When the BRIR/RIR responses are analyzed, they are represented as parameters as optimal as possible to secure an efficient bit rate. When the BRIR/RIR responses are synthesized, a BRIR/RIR is reconstructed using the parameters only.

DISCLOSURE

Technical Task

One technical task of the present disclosure is to provide an efficient audio encoding method by parameterizing a BRIR or RIR response characteristic.

Another technical task of the present disclosure is to provide an audio reproducing method and apparatus using the parameterized BRIR or RIR information.

Further technical task of the present disclosure is to provide an MPEG-H 3D audio player using the parameterized BRIR or RIR information.

Technical Solutions

In one technical aspect of the present disclosure, provided herein is a method of encoding audio by applying BRIR/RIR parameterization, the method including if an input audio signal is an RIR part, separating the input audio signal into a direct/early reflection part and a late reverberation part by applying a mixing time to the RIR part, parameterizing a direct part characteristic from the separated direct/early reflection part, parameterizing an early reflection part characteristic from the separated direct/early reflection part, parameterizing a late reverberation part characteristic from the separate late reverberation part, and transmitting the parameterized RIR part characteristic information in a manner of including the parameterized RIR part characteristic information in an audio bitstream.

The method may further include if the input audio signal is a Binaural Room Impulse Response (BRIR) part, separating the input audio signal into a Room Impulse Response (RIR) part and a Head-Related Impulse Response (HRIR) part and transmitting the separated HRIR part and the parameterized RIR part characteristic information in a manner of including the separated HRIR part and the parameterized RIR part characteristic information in an audio bitstream.

The parameterizing the early reflection part characteristic may include extracting and parameterizing a gain and propagation time information included in the direct part characteristic.

The parameterizing the direct part characteristic may include extracting and parameterizing a gain and delay information related to a dominant reflection of the early reflection part from the separated direct/early reflection part and parameterizing a model parameter information of a transfer function in a manner of calculating the transfer function of the early reflection part based on the extracted dominant reflection and the early reflection part and modeling the calculated transfer function.

The parameterizing the direct part characteristic may further include encoding the model parameter information of the transfer function into a residual information.

The parameterizing the late reverberation part characteristic may include generating a representative late reverberation part by downmixing inputted late reverberation parts and encoding the generated representative late reverberation part and parameterizing a calculated energy difference by comparing energies of the representative late reverberation part and the inputted late reverberation parts.

In one technical aspect of the present disclosure, provided herein is a method of reproducing audio based on BRIR/RIR information, the method including extracting an encoded audio signal and a parameterized Room Impulse Response (RIR) part characteristic information separately from a received audio signal, obtaining a reconstructed RIR information by separately reconstructing a direct part, an early reflection part and a late reverberation part among RIR part characteristics based on the parameterized part characteristic information, if a Head-Related Impulse Response (HRIR) information is included in the audio signal, obtaining a Binaural Room Impulse Response (BRIR) information by synthesizing the reconstructed RIR information and the HRIR information together, decoding the extracted encoded audio signal by a determined decoding format, and rendering the decoded audio signal based on the reconstructed RIR or BRIR information.

The obtaining the reconstructed RIR information may include reconstructing a direct part information based on a gain and propagation time information related to the direct part information among the parameterized part characteristics.

The obtaining the reconstructed RIR information may include reconstructing the early reflection part based on a gain and delay information of a dominant reflection and a model parameter information of a transfer function among the parameterized part characteristics.

The reconstructing the early reflection part may further include decoding a residual information on the model parameter information of the transfer function among the parameterized part characteristics.

The obtaining the reconstructed RIR information may include reconstructing the late reverberation part based on an energy difference information and a downmixed late reverberation information among the parameterized part characteristics.

In one technical aspect of the present disclosure, provided herein is an apparatus for reproducing audio based on BRIR/RIR information, the apparatus including a demultiplexer 301 extracting an encoded audio signal and a parameterized Room Impulse Response (RIR) part characteristic information separately from a received audio signal, an RIR reproducing unit 302 obtaining a reconstructed RIR information by separately reconstructing a direct part, an early reflection part and a late reverberation part among RIR part characteristics based on the parameterized part characteristic information, a BRIR synthesizing unit 303 obtaining a Binaural Room Impulse Response (BRIR) information by synthesizing the reconstructed RIR information and the HRIR information together if a Head-Related Impulse Response (HRIR) information is included in the audio signal, an audio core decoder 304 decoding the extracted encoded audio signal by a determined decoding format, and a binaural renderer 305 rendering the decoded audio signal based on the reconstructed RIR or BRIR information.

To obtain the reconstructed RIR information, the RIR reproducing unit 302 may reconstruct a direct part information based on a gain and propagation time information related to the direct part information among the parameterized part characteristics.

To obtain the reconstructed RIR information, the RIR reproducing unit 302 may reconstruct the early reflection part based on a gain and delay information of a dominant reflection and a model parameter information of a transfer function among the parameterized part characteristics.

To reconstruct the early reflection part, the RIR reproducing unit 302 may decode a residual information on the model parameter information of the transfer function among the parameterized part characteristics.

To obtain the reconstructed RIR information, the RIR reproducing unit 302 may reconstruct the late reverberation part based on an energy difference information and a downmixed late reverberation information among the parameterized part characteristics.

Advantageous Effects

The following effects are provided through an audio reproducing method and apparatus using a BRIR or RIR parameterization according to an embodiment of the present disclosure.

Firstly, by proposing a method of efficiently parameterizing BRIR or RIR information, bit rate efficiency in audio encoding may be raised.

Secondly, by parameterizing and transmitting BRIR or RIR information, an audio output reconstructed in audio decoding can be reproduced in a manner of getting closer to a real sound.

Thirdly, the efficiency of MPEG-H 3D Audio implementation may be enhanced using the next generation immersive-type three-dimensional audio encoding technique. Namely, in various audio application fields, such as a game, a Virtual Reality (VR) space, etc., it is possible to provide a natural and realistic effect in response to an audio object signal changed frequently.

BEST MODE FOR DISCLOSURE

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module", "unit" and "means" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Moreover, although the present disclosure uses Korean and English texts are used together for clarity of description, the used terms clearly have the same meaning.

Figure 2:
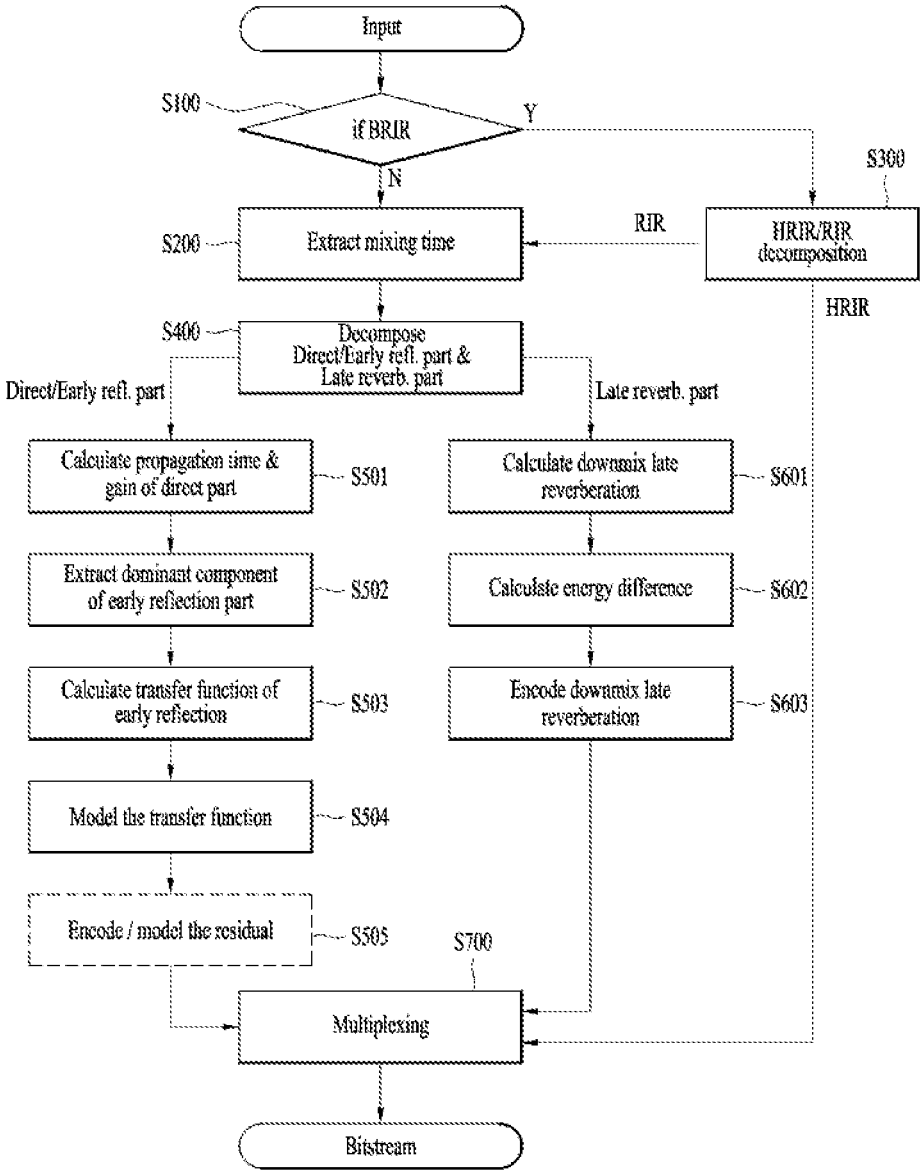
FIG. 2 is a flowchart of a process for parameterizing a BRIR/RIR in an audio encoder according to the present disclosure.

FIG. 2 is a flowchart of a process for BRIR/RIR parameterization in an audio encoder according to the present disclosure.

If a response is inputted, a step S100 checks whether the corresponding response is a BRIR. If the inputted response is the BRIR ('y' path), a step S300 decomposes HRIR/RIR to separate into an HRIR and an RIR. The separated RIR information is then sent to a step S200. If the inputted response is not BRIR, i.e., RIR ('n' path), the step S200 extracts mixing time information from the inputted RIR by bypassing the step S300.

A step S400 decomposes the RIR into a direct/early reflection part (referred to as 'D/E part') and a late reverberation part by applying a mixing time to the RIR. Thereafter, a process (i.e., steps S501 to S505) for parameterization by analyzing a response of the direct/early reflection part and a process (i.e., steps S601 to S603) for parameterization by analyzing a response of the late reverberation part proceed respectively.

The step S501 extracts and calculates a gain of the direct part and propagation time information (this is a sort of one of delay informations). The step S50 extracts a dominant reflection component of the early reflection part by analyzing the response of the directly/early reflection part (D/E part). The dominant reflection component may be represented as a gain and delay information like analyzing the direct part. The step S503 calculates a transfer function of the early reflection part using the extracted dominant reflection component and the early reflection part response. The step S504 extracts model parameters by modeling the calculated transfer function. The step S505 is an optionally operational step and models residual information of a non-modeled transfer function by encoding or in a separate way if necessary.

The step S601 generates a single representative late reverberation part by downmixing the inputted late reverberation parts. The step S602 calculates an energy difference by analyzing energy relation between the downmixed representative late reverberation part and the inputted late reverberation parts. The step S603 encodes the downmixed representative late reverberation part.

A step S700 generates a bitstream by multiplexing the mixing time extracted in the step S200, the gain and propagation time information of the direct part extracted in the step S501, the gain and delay information of the dominant reflection component extracted in the step S502, the model parameter information modeled in the step S504, the residual information (in case of using optionally) in the step S505, the energy difference information calculated in the step S602*m* and the data information of the encoded downmix part in the step S603.

Figure 3:
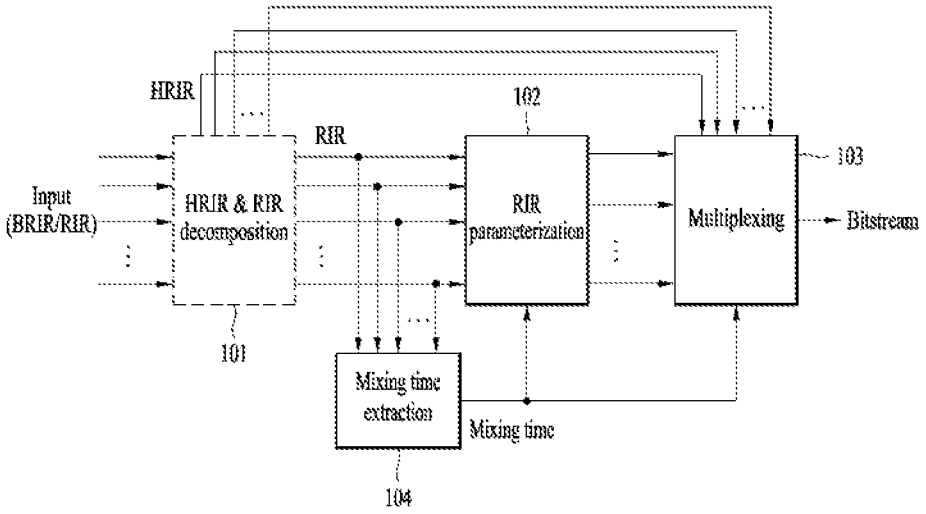
FIG. 3 is a block diagram showing a BRIR/RIR parameterization process in an audio encoder according to the present disclosure.

FIG. 3 is a block diagram showing a BRIR/RIR parameterization process in an audio encoder according to the present disclosure. Particularly, FIG. 3 is a diagram showing a whole process for BRIR/RIR parameterization to efficiently transmit a BRIR/RIR required for a VR audio from an audio encoder (e.g., a transmitting end).

A BRIR/RIR parameterization block diagram in an audio encoder according to the present disclosure includes an HRIR & RIR decomposing unit (HRIR & RIR decomposition) 101, an RIR parameter generating unit (RIR parameterization) 102, a multiplexer (multiplexing) 103, and a mixing time extracting unit (mixing time extraction) 104.

First of all, whether to use the HRIR & RIR decomposing unit 101 is determined depending on an input response type. For example, if a BRIR is inputted, an operation of the HRIR & RIR decomposing unit 101 is performed. If an RIR is inputted, the inputted RIR part may be transferred intactly without performing the operation of the HRIR & RIR decomposing unit 101. The HRIR & RIR decomposing unit 101 plays a role in separating the inputted BRIR into an HRIR and an RIR and then outputting the HRIR and the RIR.

The mixing time extracting unit 104 extracts a mixing time by analyzing a corresponding part for the RIR outputted from the HRIR & RIR decomposing unit 101 or an initially inputted RIR.

The RIR parameter generating unit 102 receives inputs of the extracted mixing time information and RIRs and then extracts dominant components that feature the respective parts of the RIR as parameters.

The multiplexer 103 generates an audio bitstream by multiplexing the extracted parameters, the extracted mixing time information, and HRIR informations, which were extracted separately, together and then transmits it to an audio decoder (e.g., a receiving end).

Figure 4:
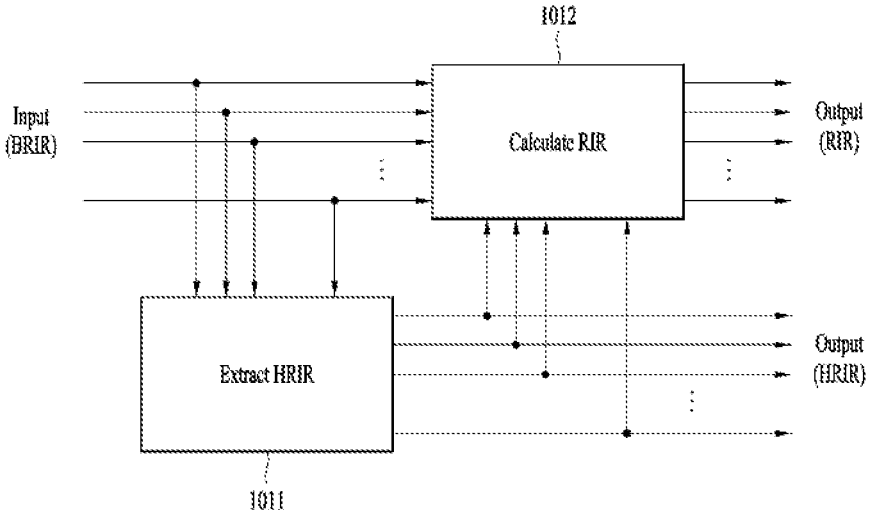
FIG. 4 is a detailed block diagram of an HRIR & RIR decomposing unit 101 according to the present disclosure.

Specific operations of the respective elements shown in FIG. 3 are described in the following. FIG. 4 is a detailed block diagram of the HRIR & RIR decomposing unit 101 according to the present disclosure. The HRIR & RIR decomposing unit 101 includes an HRIR extracting unit (Extract HRIR) 1011 and an RIR calculating unit (Calculate RIR) 1012.

Figure 5:
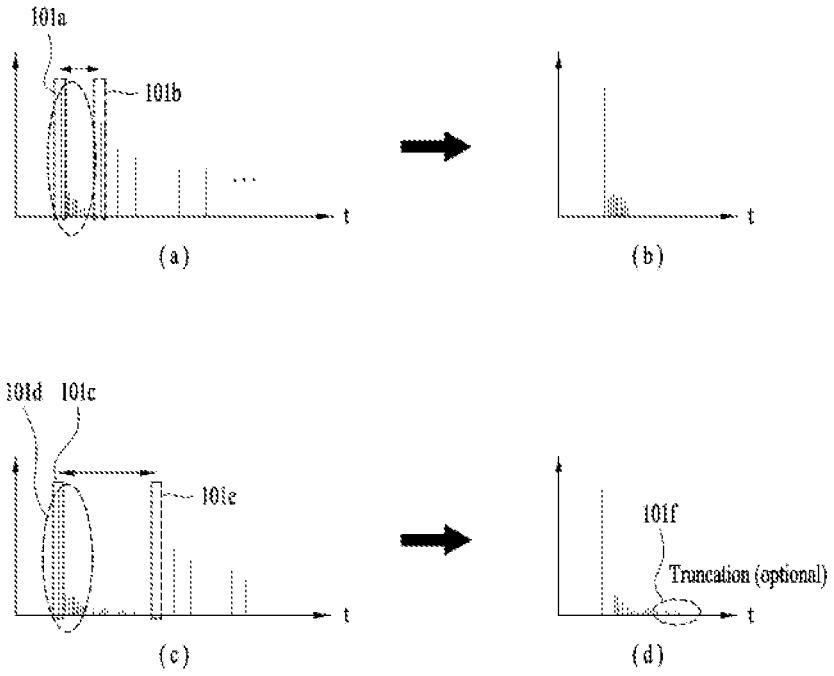
FIG. 5 is a diagram to describe an HRIR & RIR decomposition process according to the present disclosure.

If a BRIR is inputted to the HRIR & RIR decomposing unit 101, the HRIR extracting unit 1011 extracts an HRIR by analyzing the inputted BRIR. Generally, a response of the BRIR is similar to that of an RIR. Yet, unlike the RIR having a single component existing in a direct part, small components further exist behind the direct part. Since the corresponding components including the direct part component are formed by user's body, head size and ear shape, they may be regarded as Head-Related Transfer Function (HRTF) or Head-Related Impulse Response (HRIR) components. Considering this, an HRIR may be obtained by detecting a direct part response portion of the inputted BRIR only. When a response of the direct part is extracted, a next response component 101*b* detected next to a response component 101*a* having a biggest magnitude is extracted additionally, as shown in FIG. 5 (*a*). Although a length of the extracted response is not determined, a response feature between a big-magnitude response component (i.e., direct component) 101*a* of a start part and a response component 101*b* (e.g., a start response component of the early reflection part) having a magnitude next to the response component 101*a*, i.e., the duration of an Initial Time Delay (ITDG) may be regarded as an HRIR response. Hence, a region of a dotted line ellipse denoted in FIG. 5 (*a*) is extracted by being regarded as an HRIR signal. The extraction result is similar to FIG. 5 (*b*).

Alternatively, without progressing the above process, it is possible to automatically extract about 10 ms behind a direct part component 101*c* or a directly-set response length only (e.g., 101*d*). Namely, since the response characteristic is the information corresponding to both ears, it is preferable to preserve the extracted response intactly if possible. Yet, if there are too many unnecessarily extracted portions (e.g., a response component of an early reflection is generated too late due to a too large room [e.g., 101*e*, FIG. 5 (*c*)] or it is necessary to reduce an information size of an extracted response, a necessary portion of the response may be truncated optionally by starting with an end portion of the response [101*f*, FIG. 5 (*d*)]. In this regard, generally, if a HRTF has a length of about 5 ms, its features can be represented sufficiently. If a size of a space is not very small, an early reflection component is generated after minimum 5 ms. Therefore, in a general situation, HRTF may be assumed as represented sufficiently. A feature component indicating an open form or an approximate envelope of HRTF is normally distributed on a front part of a response and a rear portion component of the response enables the open form of the HRTF to be represented more elaborately. Hence, as a BRIR is measured in a very small space, although an early reflection is generated after a direct part before 5 ms, if values between the ITDGs are extracted, open form feature information of the HRTF can be extracted. Actually, although accuracy may be lowered slightly, it is possible to use a low-order HRTF only for efficient operation by filtering the corresponding HRTF. Namely, this case reflects open form information of the HRTF only.

As the RIR calculating unit 1012 shown in FIG. 4 is performed on each BRIR, if 2*M BRIRs ($BRIR_{L_1}$, $BRIR_{R_1}$, $BRIR_{L_2}$, $BRIR_{R_2}$, . . . $BRIR_{L_M}$, $BRIR_{R_M}$) are inputted, 2*M HRIRs ($HRIR_{L_1}$, $HRIR_{R_1}$, $HRIR_{L_2}$, $HRIR_{R_2}$, . . . $HRIR_{L_M}$, $HRIR_{R_M}$) are outputted. If the HRIRs are extracted, RIR is calculated in a manner of inputting the corresponding response to the RIR calculating unit 1012 together with the inputted BRIR. An output y(n) in a random Linear Time Invariant (LTI) system is calculated as a convolution of an input x(n) and a transfer function h(n) of the system (e.g., y(n)=h(n)*x(n)). Hence, since BRIR of both ears can be calculated through the convolution of HRIR (HRTF) and RIR of both ears, if we are aware of the BRIR and the HRIR, RIR can be found conversely. In the operating process of the RIR calculating unit 1012, if HRIR, BRIR and RIR are assumed as an input, an output and a transfer function, respectively, the RIR may be calculated as Equation 1 in the following.

$$brir(n)=rir(n)*hrir(n)\Rightarrow BRIR(f)=RIR(f)HRIR(f),$$

$$RIR(f)=BRIR(f)/HRIR(f)\Rightarrow rir(n) \qquad \text{[Equation 1]}$$

In Equation 1, hrir(n), brir(n) and rir(n) mean that HRIR, BRIR and RIR are used as an input, an output and a transfer function, respectively. Moreover, a lower case means a time-axis signal and an upper case means a frequency-axis signal. Since the RIR calculating unit 1012 is performed on each BRIR, if total 2*M BRIRs are inputted, 2*M RIRs ($rir_{L_1}$, $rir_{R_1}$, $rir_{L_2}$, $rir_{R_2}$, . . . $rir_{L_M}$, $rir_{R_M}$) are outputted.

Figure 6:
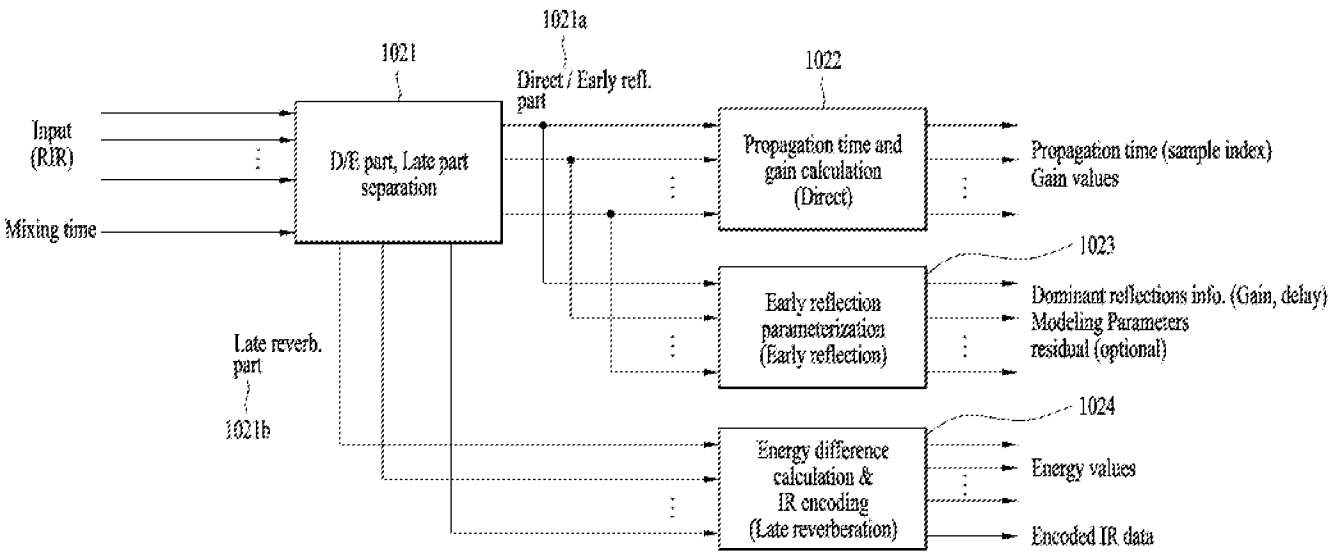
FIG. 6 is a detailed block diagram of an RIR parameter generating unit 102 according to the present disclosure.

FIG. 6 is a detailed block diagram of the RIR parameter generating unit 102 according to the present disclosure. The RIR parameter generating unit 102 includes a response component separating unit (D/E part, Late part separation) 1021, a direct response parameter generating unit (propagation time and gain calculation) 1022, an early reflection response parameter generating unit (early reflection parameterization) 1023 and a late reverberation response parameter generating unit (energy difference calculation & IR encoding) 1024.

The response component separating unit 1021 receives an input of RIR extracted from BRIR and an input of a mixing time information extracted through the mixing time extracting unit 104, through the HRIR & RIR decomposing unit 101. The response component separating unit 1021 separates the inputted RIR component into a direct/early reflection part 1021*a* and a late reverberation part 1021*b* by referring to the mixing time.

Subsequently, the direct part is inputted to the direct response parameter generating unit 1022, the early reflect part is inputted to the early reflection response parameter generating unit 1023, and the late reverberation part is inputted to the late reverberation response parameter generating unit 1024.

The mixing time is the information indicating a timing point at which the late reverberation part starts on a time axis and may be representatively calculated by analyzing correlation of responses. Generally, the late reverberation part 1021*b* has the strong stochastic property unlike other parts. Hence, if correlation between a total response and a response of the late reverberation part is calculated, it may result in a very small numerical value. Using such a feature, an application range of a response is gradually reduced by starting with a start point of the response. Thus, a change of correlation is observed. In doing so, if a decreasing point is found, the corresponding point is regarded as the mixing time.

The mixing time is applied to each RIR. Hence, if M RIRs ($rir_{_1}$, $rir_{_2}$, . . . , $rir_{_M}$) are inputted, M direct/early reflection parts ($ir_{DE_1}$, $ir_{DE_2}$, . . . , $ir_{DE_M}$) and M late reverberation parts ($ir_{late_1}$, $ir_{late_2}$, . . . $ir_{late_M}$) are outputted [The number is expressed as M on the assumption that an inputted response type is RIR. If the inputted response type is BRIR, it may be assumed that 2*M direct/early reflection parts ($ir_{L_DE_1}$, $ir_{R_DE_1}$, $ir_{L_DE_2}$, $ir_{R_DE_2}$, . . . , $ir_{L_DE_M}$, $ir_{R_DE_M}$) and late reverberation parts ($ir_{L_late_1}$, $ir_{R_late_1R}$, $ir_{L_late_2L}$, $ir_{R_late_2}$, . . . , $ir_{L_late_ML}$, $ir_{R_late_M}$) are outputted.]. If a measured position of an inputted RIR is different, a mixing time may change. Namely, a start point of a late reverberation of every RIR may be different. Yet, assuming that every RIR is measured by changing a position in the same space only, since a mixing time difference between RIRs is not significant, a single representative mixing time to be applied to every RIR is selected and used for convenience in the present disclosure. The representative mixing time may be used in a manner of measuring mixing times of all RIRs and then taking an average of them. Alternatively, a mixing time for an RIR measured at a central portion in a random space may be used as a representative.

Figure 7:
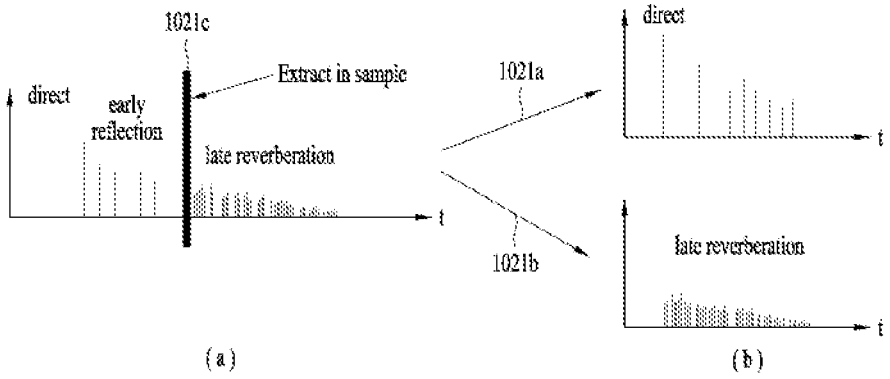
FIGS. 7 to 15 are diagrams to describe specific operations of the respective blocks in the RIR parameter generating unit 102 according to the present disclosure.

In this regard, FIG. 7 shows an example of separating an RIR inputted to the response component separating part 1021 into a direct/early reflection part 1021*a* and a late reverberant part 1021*b* by applying a mixing time to the RIR.

FIG. 7 (*a*) shows a position of a calculated mixing time (1021*c*), and FIG. 7 (*b*) shows a result from being separated into the direct/early reflection part 1021*a* and the late reverberation part 1021*b* by a mixing time value. Although a direct part response and an early reflection part response are not distinguished from each other through the response component separating part 1021, a first-recorded response component (generally having a biggest magnitude in a response) may be regarded as a response of a direct part and a second-recorded response component may be regarded as a point from which a response of an early reflection part starts. Hence, if the D/E part response 1021*a* separated from the RIR is inputted to the direct response parameter generating unit 1022, gain information and position information of a response having a biggest magnitude at the start point of the D/E part response may be extracted and used a parameter indicating a feature of the direct part. In this regard, the position information may be represented as a delay value on a time axis, e.g., a sample value. The direct response parameter generating unit 1022 analyzes each inputted D/E part response and extracts informations. Hence, if M D/E part responses are inputted to the direct response parameter generating unit 1022, total M gain values ($G_{Dir_1}$, $G_{Dir_2}$, . . . , $G_{Dir_M}$) and M delay values ($Dly_{Dir_1}$, $Dly_{Dir_2}$, . . . , $Dly_{Dir_M}$) are extracted as parameters.

Figure 1:
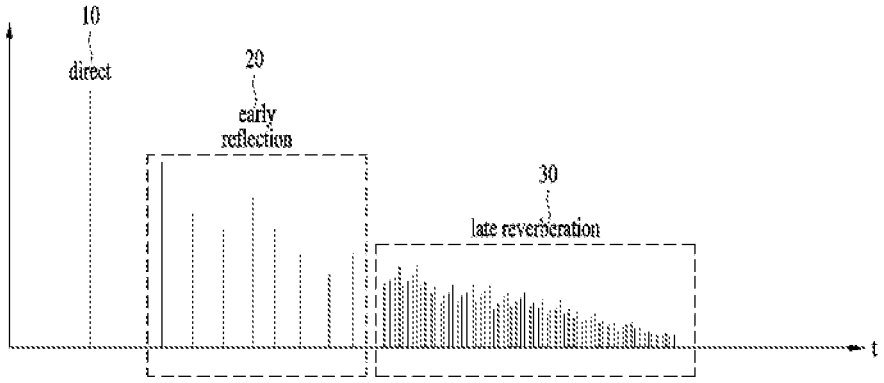
FIG. 1 is a diagram to describe the concept of the present disclosure.
Figure 8:
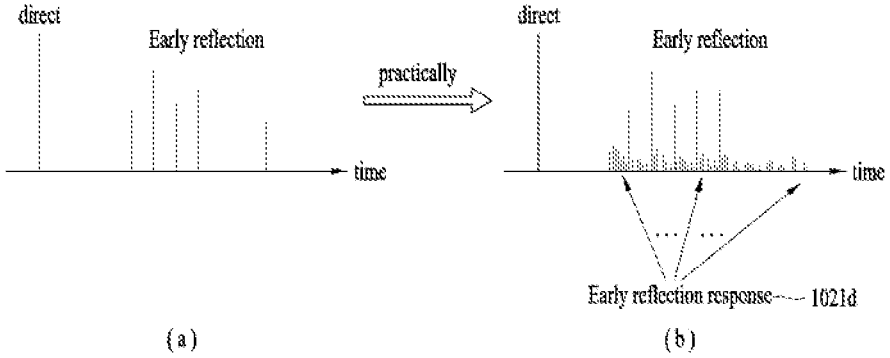

Generally, when a response of RIR is illustrated, it is shown as FIG. 1. Yet, if an early reflection part response is illustrated only, it may be shown as FIG. 8. FIG. 8 (*a*) shows that the direct & early reflection part of FIG. 1 or the D/E part response 1021*a* of FIG. 7 (*a*) is extracted. FIG. 8 (*b*) represents the response of FIG. 8 (*a*) as a characteristic practically close to a real response. Referring to FIG. 8 (*b*), small responses are added behind an early reflection component. An early reflection component in RIR includes responses recorded after having been reflected once, twice or thrice by a ceiling, a floor, a wall and the like in a closed space. Hence, the moment a random impulse sound bounces off a wall, a reflected sound is generated and small reflected sounds are additionally generated from the reflection as well. For example, assume that a thin wooden board is punched with a fist. The moment the wooden board is punched with the fist, a punched sound is primarily generated from the wooden board. Subsequently, the wooden board fluctuates back and forth, whereby small sounds are generated. Such sound may be well perceived depending on the strength of the first with which the wooden board is punched. An early reflection component of RIR recorded in a random space may be considered with the same principle. Unlike a component of a direct part instantly recorded when a sound starts to be generated, regarding a component of an early reflection part, small reflected sounds generated from reflection may be contained in a response component as well as a component of an early reflection itself. Here, such small reflected sounds will be referred to as an early reflection minor sound (early reflection response) 1021*d*. Reflection characteristics of such small reflected sounds including the early reflection component may change significantly according to properties of the floor, ceiling and wall. Yet, the present disclosure assumes that the property differences of the materials constituting the space are not significant. According to the present disclosure, the early reflection response parameter generating unit 1023 of FIG. 6 extracts feature informations of the early reflection component and generates them as parameters, by considering the early reflection response 1021*d* together.

Figure 9:
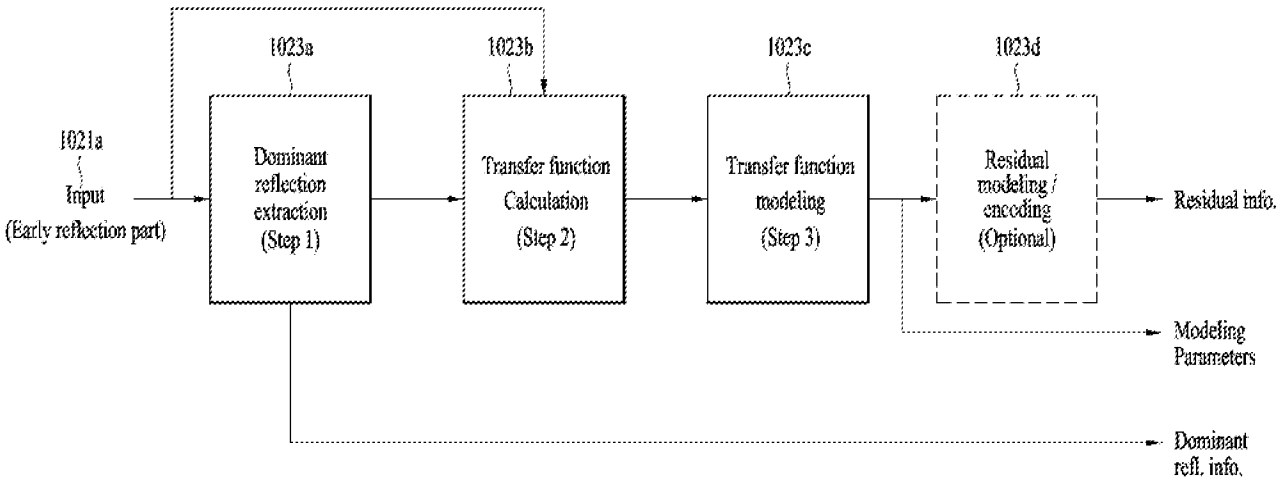

FIG. 9 shows a whole process of early reflection component parameterization by the early reflection response parameter generating unit 1023. Referring to FIG. 9, the whole process of early reflection component parameterization according to the present disclosure includes three essential steps (step 1, step 2 and step 3) and one optional step.

As an input to the early reflection response parameter generating unit 1023, a D/E part response 1021*a* identical to the response previously used in extracting the response information of the direct part is used. First of all, a first step (step 1) 1023*a* is a dominant reflection component extracting step and extracts an energy-dominant component from an early reflection part of a D/E part only. Generally, energy of a small reflection, which is formed additionally after reflection, i.e., the early reflection response 1021*d* may be considered very smaller than that of the early reflection component. Hence, if an energy dominant portion in the early reflection part is discovered and extracted, the early reflection component may be extracted only. In the present disclosure, one energy-dominant component is assumed as extracted by periods of 5 ms. Yet, instead of using such a method, if a dominant reflection component is discovered in a manner of searching for a component having especially big energy while comparing energies of adjacent components, it may be discovered more accurately.

Figure 10:
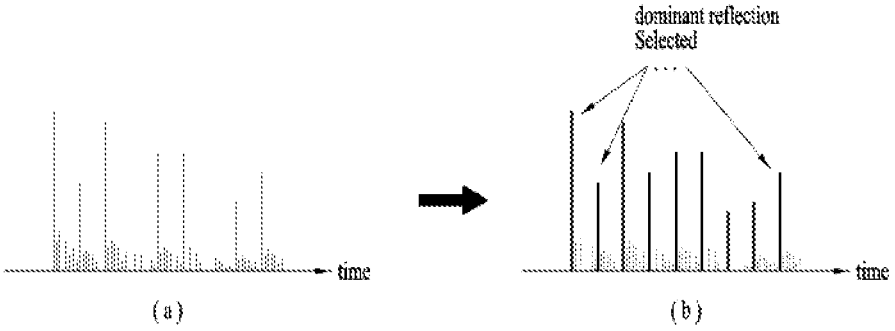

In this regard, FIG. 10 shows a process for extracting dominant reflection components from an early reflection part. FIG. 10 (*a*) shows a response of an inputted early reflection part, and FIG. 10 (*b*) shows the selected result of the dominant reflection components. The dominant reflection components are denoted by bold solid lines. Like the case of extracting the feature of the direct part component, for the corresponding components, gain information and position information (i.e., delay information) of each component are extracted as parameters. Although the parameters for the early reflection part are extracted without accurately distinguishing the direct part and the early reflection part from each other, position information used in extracting the feature of the dominant component basically includes a start point of the early reflection part (position information of a second dominant component). Hence, when the feature of the early reflection part is analyzed, it is safe to intactly use a D/E part response coexisting with the direct part.

A response having the dominant reflection components extracted only is used for the transfer function calculating process (calculate transfer function of early reflection), which is the second step (step 2) 1023*b*. A process for calculating a transfer function of an early reflection component is similar to the first-described method used in calculating HRIR from BRIR. Generally, a signal, which is outputted when a random impulse is inputted to a system, is called an impulse response. In the same meaning, if a random impulse sound is reflected by bouncing off a wall, a reflection sound and a reflection response sound by the reflection are generated together. Hence, an input reflection may be considered as an impulse sound, a system may be considered as a wall surface, and an output may be considered as a reflection sound and a reflection response sound separately. Assuming that the property difference of wall surface material constituting a space is not significant, the features of reflection responses of all early reflections may be regarded as similar to each other. Hence, considering that the dominant reflection components extracted in the first step (step 1) 1023*a* are the input of a system and that an early reflection part of a D/E part response is the output of the system, a transfer function of the system may be estimated using the input-output relation in the same manner of Equation 1.

Figure 11:
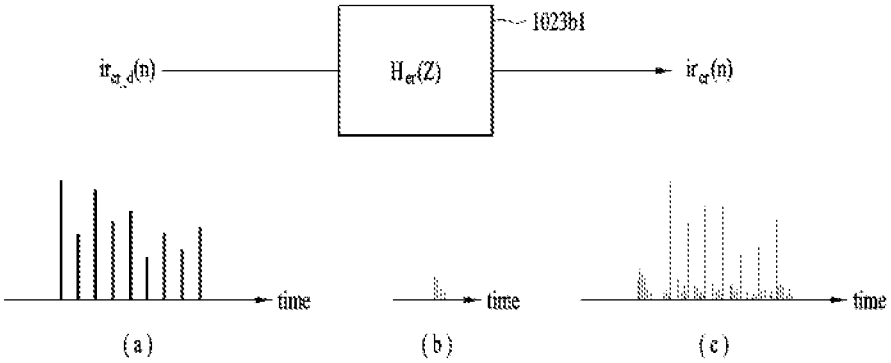

FIG. 11 shows the transfer function process. An input response used to calculate a transfer function is the response shown in FIG. 11 (*a*), which is a response extracted as a dominant reflection component in the first step (step 1) 1023*a*. A response shown in FIG. 11 (*c*) is the response generated from extracting an early reflection part only from a D/E part response and includes the aforementioned early reflection response 1021*d* as well. Hence, using Equation 2 in the following, a transfer function of the corresponding system may be calculated. The calculated transfer function means a response shown in FIG. 11 (*b*).

$$ir_{er}(n) = h_{er}(n) * ir_{er_dom}(n) \Rightarrow IR_{er}(f) = H_{er}(f) IR_{er_dom}(f), \quad \text{[Equation 2]}$$

$$H_{er}(f) = \frac{IR_{er}(f)}{IR_{er_dom}(f)} \Rightarrow h_{er}(n)$$

In Equation 2, $i_{rer_dom}(n)$ means a response generated from extracting dominant reflection components only in the first step (step 1) 1023*a*, $ir_{er}(n)$ means the response (FIG. 11 (*b*)) of the early reflection part of the D/E part, and $h_{er}(n)$ means a system response (FIG. 11 (*c*)).

The calculated transfer function may be considered as representing a feature of a wall surface as a response signal. Hence, if a random reflection is allowed to pass through a system having the transfer function like FIG. 11 (*b*), an early reflection response like FIG. 11 (*c*) is outputted together. Hence, if a dominant reflection component is accurately extracted, an early reflection part for the corresponding space may be calculated.

The third step (step 3) 1023*c* is a process for modeling the transfer function calculated in the second step 1023*b*. Namely, the result calculated in the second step 1023*b* may be transmitted as it is. Yet, in order to transmit information more efficiently, the transfer function is transformed into a parameter in the third step 1023*c*. Generally, each response bouncing off a wall surface normally has a high frequency component attenuating faster than a low frequency component.

Figure 12:
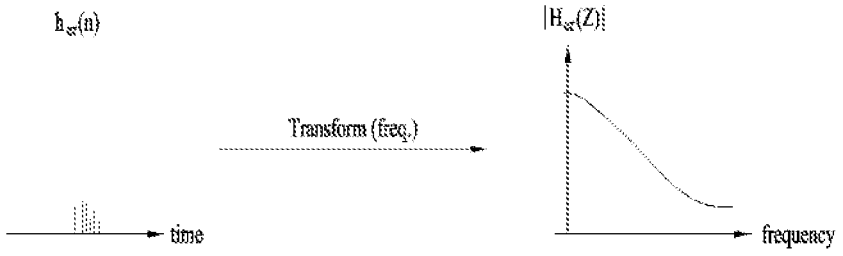

Therefore, the transfer function in the second step 1023*b* generally has a response form shown in FIG. 12. FIG. 12 (*a*) shows the transfer function calculated in the second step 1023*b*, and FIG. 12 (*b*) schematically shows an example of a result from transforming the corresponding transfer function into a frequency axis. The response feature shown in FIG. 12 (*b*) may be similar to that of a low-pass filter. Hence, the transfer function of FIG. 12 may extract an open form of the transfer function as a parameter using 'all zero model' or 'Moving Average (MA) model'. For one example, as there is 'Durbin's method' as a representative MA modeling method, a parameter for a transfer function may be extracted using the corresponding method. For another example, it is possible to extract a parameter of a response using 'Auto Regression Moving Average (ARMA) model'. As a representative 'ARMA modeling' method, there is 'Prony's method'. In performing a transfer function modeling, a modeling order may be set arbitrarily. As the order is raised higher, the modeling can be performed accurately.

Figure 13:
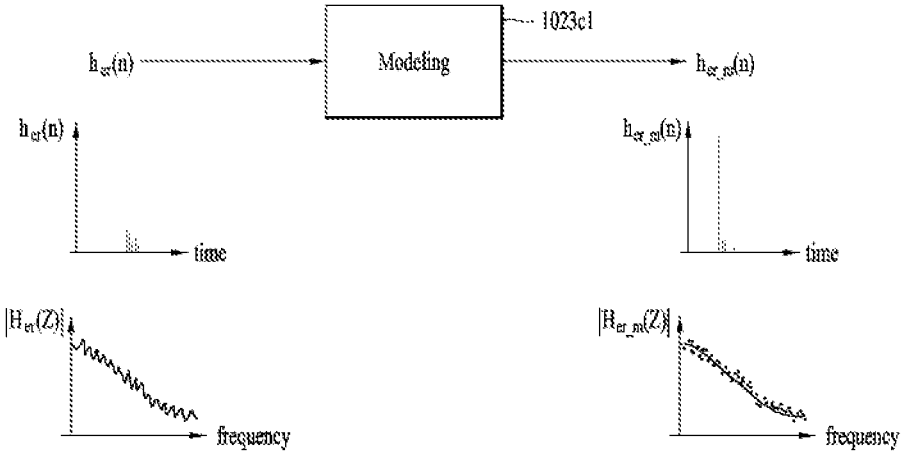

FIG. 13 shows an input and output of the third step 1023*c*. In FIG. 13 (*a*), an output $h_{er}(n)$ of the second step 1023*b*, i.e., the transfer function is illustrated as a time axis and a frequency axis (magnitude response). In FIG. 13 (*b*), an output $h_{er}(n)$ of the third step 1023*c* is illustrated as a time axis and a frequency axis (magnitude response). The result estimated through the modeling 1023*c*1 of FIG. 12 is denoted by a solid line on the frequency axis of FIG. 13 (*b*). Generally, an open form of a frequency response of a transfer function may represent a response form using a model parameter only if not based on stochastic. Yet, it is unable to accurately represent a random response or transfer function using a parameter only. Moreover, although an order of a parameter is raised, supplementation is possibly only but there still exists a difference between an input and an output. Hence, after modeling, a residual component is always generated. The residual component may be calculated with a difference between an input and an output, and a residual component $res_{er}(n)$) generated by the third step 1023*c* may be calculated through Equation 3 in the following.

$$res_{er}(n) = h_{er}(n) - h_{er_m}(n) \quad \text{[Equation 3]}$$

As described with reference to FIG. 9, an early reflection response (i.e., early reflection part) may parametrize dominant informations through the three kinds of the steps 1 to 3. And, the feature of the early reflection may be sufficiently represented using the corresponding parameter only.

Yet, in case of attempting to find an early reflection component optionally or more accurately, it is possible to additionally transmit the residual component by modeling or encoding it [optional step in FIG. 9, 1023*d*]. According to the present disclosure, when a residual component is transmitted using the modeling method, a basic method of residual modeling is described as follows.

First of all, a residual component is transformed into a frequency axis, and a representative energy value per frequency band is then calculated and extracted only. The calculated energy value is used as representative information of the residual component only. When the residual component is regenerated later, a white noise is randomly generated and then transformed into a frequency axis. Subsequently, energy of the frequency band of the white noise is changed by applying the calculated representative energy value to the corresponding frequency band. The residual made through this procedure is known as deriving a similar result in perceptual aspect in case of being applied to a music signal despite having a different result in signal aspect. In addition, in case of transmitting a residual component using an encoding method, the existing general random codec of the related art may apply intactly. This will not be described in detail.

The whole process for the early reflection parameterization by the early reflection response parameter generating unit 1023 is summarized as follows. The dominant reflection component extraction (early reflection extraction) of the first step 1023*a* is performed for each D/E part response. Hence, if M D/E part responses are used as input, a response from which total M dominant reflection components are detected is outputted in the first step 1023*a*. If V dominant reflection components are detected for all D/E part responses, total M*V informations may be extracted in the first step 1023*a*. In detail, since information of each reflection is configured with a gain and a delay, the number of informations is total 2*M*V. The corresponding informations should be packed and stored in a bitstream so as to be used for the future reconstruction in the decoder. The output of the first step 1023*a* is used as an input of the second step 1023*b*, whereby a transfer function is calculated through the input-output relation shown in FIG. 11 [see Equation 2]. Hence, in the second step 1023*b*, total M responses are inputted and M transfer functions are outputted. In the third step 1023*c*, each of the transfer functions outputted from the second step 1023*b* is modeled. Hence, if M transfer functions are outputted from the second step 1023*b*, total M model parameters for the respective transfer functions are generated in the third step 1023*c*. Assuming that a modeling order for modeling each transfer functions is P, total M*P model parameters may be calculated. The corresponding information should be stored in a bitstream so as to be used for reconstruction.

Figure 14:
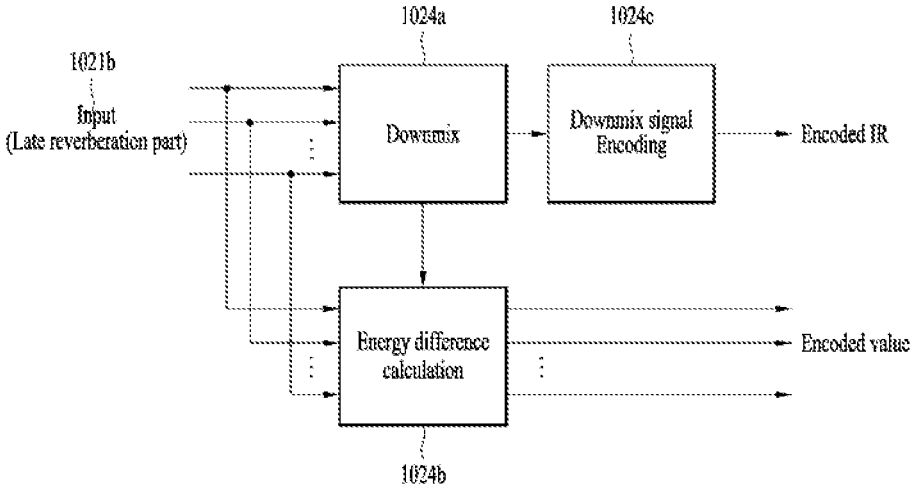

Generally, regarding a late reverberation component, a characteristic of a response is similar irrespective of a measured position. Namely, when a response is measured, a response size may change depending on a distance between a microphone and a sound source but a response characteristic measured in the same space has no big difference statistically no matter where it is measured. By considering such a feature, feature informations of a late reverberation part response are parameterized by the process shown in FIG. 14. FIG. 14 shows a specific process of the late reverberation response parameter generating unit (energy difference calculation & IR encoding) 1024 described with reference to FIG. 6. First of all, a single representative late reverberation response is generated by downmixing all the inputted late reverberation part responses 1021*b* [1024*a*]. Subsequently, feature information is extracted by comparing energy of the downmixed late reverberation response with energy of each of the inputted late reverberation responses [1024*b*]. The energy may be compared on a frequency or time axis. In case of comparing energy on a frequency axis, all the inputted late reverberation responses including the downmixed late reverberation response are transformed into the time/frequency axis and coefficients of the frequency axis are then bundled in band unit similarly to resolution of a human auditory organ.

Figure 15:
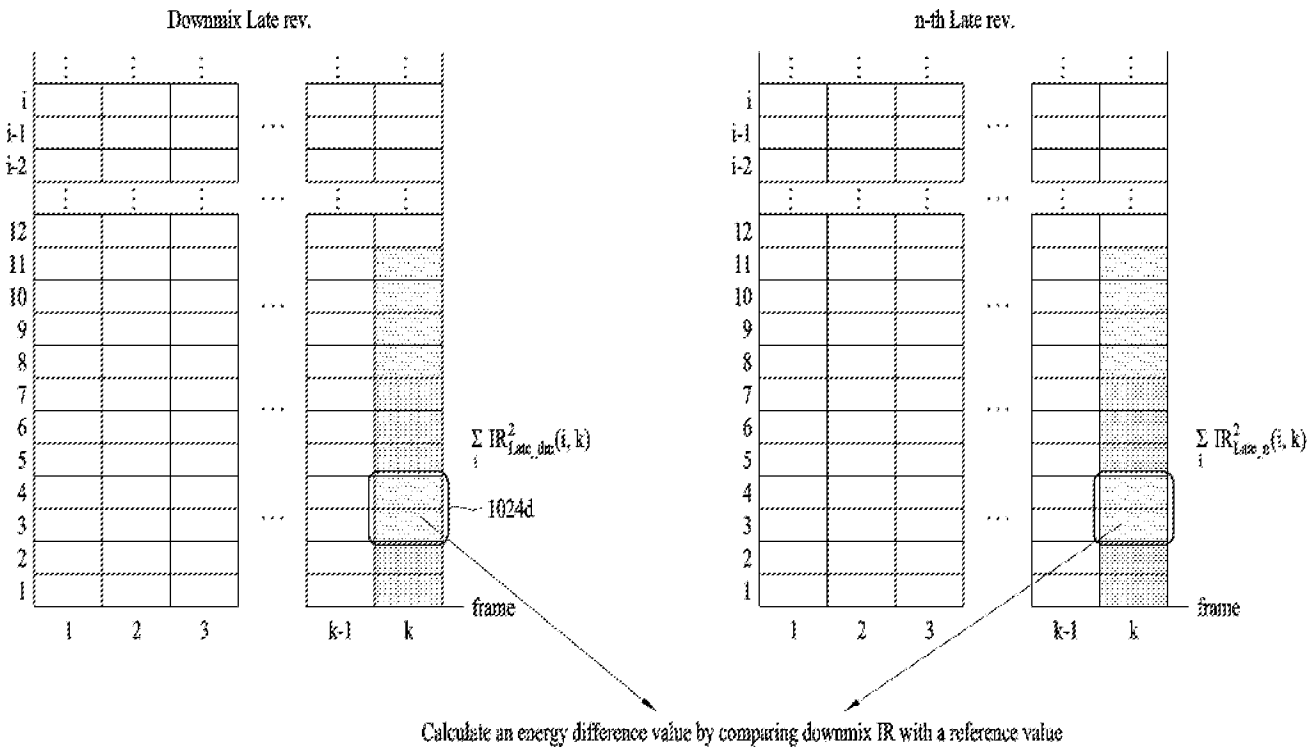

In this regard, FIG. 15 shows an example of a process for comparing energy of a response transformed into a frequency axis. In FIG. 15, frequency coefficients having the same shade color consecutively in a random frame k are grouped to form a single band (e.g., 1024*d*). For the random frequency band (1024*d*) b, an energy difference between a downmixed late reverberation response and an inputted late reverberation response may be calculated through Equation 4.

$$D_{NRG_m}(b,k) = 10\log_{10}\frac{\sum_i IR^2_{Late_m}(i,k)}{\sum_i IR^2_{Late_dm}(i,k)},\ m = 1, \ldots, M \quad \text{[Equation 4]}$$

In Equation 4, $IR_{Late_m}(i,k)$ means an $m^{th}$ inputted late reverberation response coefficient transformed into a time/frequency axis, and $IR_{Late_dm}(i,k)$ means a downmixed late reverberation response coefficient transformed into a time/frequency axis. In Equation 4, i and k mean a frequency coefficient index and a frame index, respectively. In Equation 4, a sigma symbol is used to calculate an energy sum of the respective frequency coefficients bundled into a random band, i.e., the energy of a band. Since there are total M inputted late reverberation responses, M energy difference values are calculated per frequency band. If the band number is total B, there are total B*M energy differences calculated in a random frame. Hence, assuming that a frame length of each response is equal to K, the energy difference number becomes total K*B*M. All the calculated values should be stored in a bitstream as the parameters indicating features of the respective inputted late reverberation responses. As the downmixed late reverberation response is the information required for reconstructing the late reverberation in a decoder as well, it should be transmitted together with the calculated parameter. Moreover, in the present disclosure, the downmixed late reverberation response is transmitted by being encoded [1024*c*]. Particularly, in the present disclosure, since there always exists only one downmixed late reverberation response irrespective of the inputted late reverberation response number and the downmixed late reverberation response is not longer than a normal audio signal, the downmixed late reverberation response can be encoded using a random encoder of a lossless coding type.

An output parameter and energy values for the late reverberation response 1021*b* and an encoded IR for the late reverberation response 1021*b* mean an energy difference value and an encoded downmix late reverberation response, respectively. When energy is compared on a time axis, a downmixed late reverberation response and all inputted late reverberation responses are separated. Subsequently, an energy difference value between a response downmixed for each of the separated responses and an input response is calculated in a manner similar to the process performed on the frequency axis [1024*b*]. The calculated energy difference value information should be stored in a bitstream.

When the energy difference value information calculated on the frequency or time axis like the above-described process is sent, a downmixed late reverberation response is necessary to reconstruct a late reverberation in a decoder. Yet, alternatively, when energy information of an input late reverberation response is directly used as parameter information instead of the energy difference value information, a separate downmixed late reverberation may not be necessary to reconstruct the late reverberation in the decoder. This is described in detail as follows. First of all, all the inputted late reverberation responses are transformed into a time/frequency axis and 'Energy Decay Relief (EDR)' is then calculated. The EDR may be basically calculated as Equation 5.

$$EDR_{Late_m}(i,k)=\sum_{k=1}^{K} IR_{Late}^{2}(i,k) \quad \text{[Equation 5]}$$

In Equation 5, $EDR_{Late_m}(i,k)$ means an EDR of an $m^{th}$ late reverberation response. Calculation is performed in a manner of adding energies up to a response end in a random frame by referring to Equation 5. Thus, EDR is the information indicating a decay shape of energy on a time/frequency axis. Hence, energy variation according to a time change of a random late reverberation can be checked per frequency unit through the corresponding information. Moreover, length information of a late reverberation response may be extracted instead of encoding the late reverberation response. Namely, when a late reverberation response is reconstructed at a receiving end, length information is necessary. Hence, it should be extracted at a transmitting end. Yet, since a single mixing time, which is calculated as a representative value when a D/E part and a late reverberation part are distinguished from each other, is applied to every late reverberation response, lengths of the inputted late reverberation responses may be regarded as equal to each other. Hence, length information may be extracted by randomly selecting one of the inputted late reverberation responses. To reconstruct a late reverberation response in a decoder described later, white noise is newly generated and energy information is then applied per frequency.

Figure 16:
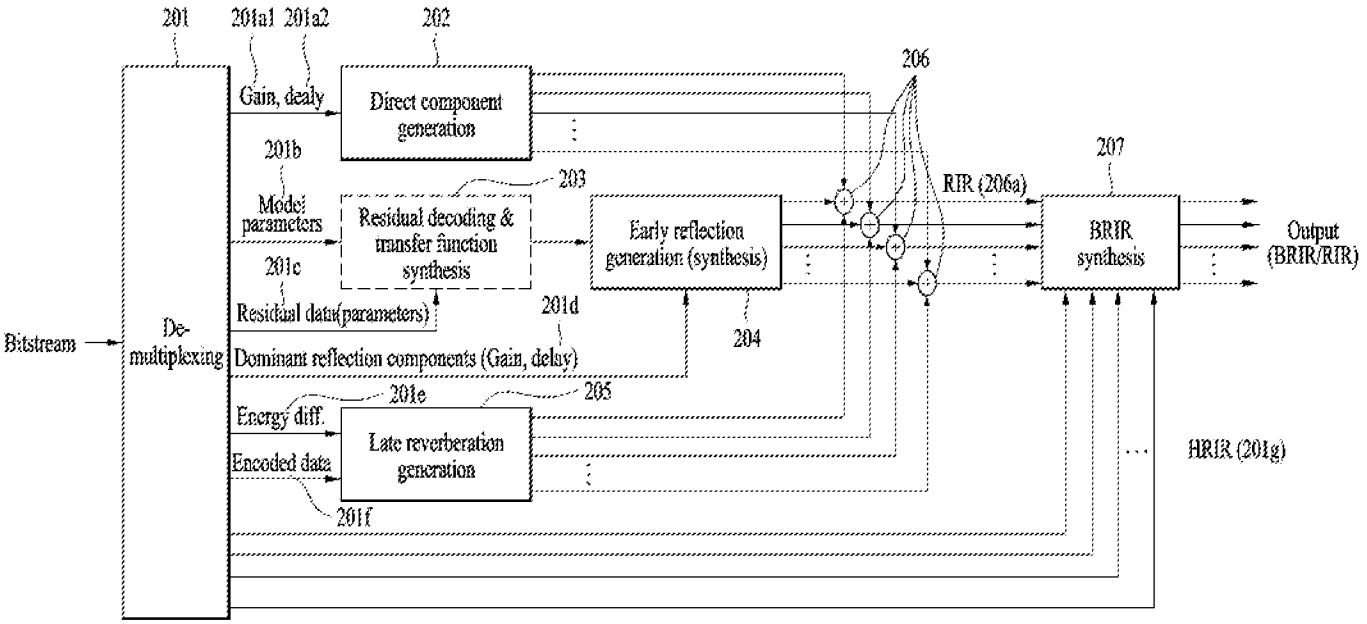
FIG. 16 is a block diagram of a specific process for reconstructing a BRIR/RIR parameter according to the present disclosure.

FIG. 16 is a block diagram of a specific process for reconstructing a BRIR/RIR parameter according to the present disclosure. FIG. 16 shows a process for reconstructing/synthesizing BRIR/RIR information using BRIR/RIR parameters packed in a bitstream through the aforementioned parameterization of FIGS. 2 to 15.

First of all, through a demultiplexer (demultiplexing) 201, the aforementioned BRIR/RIR parameters are extracted from an input bitstream. The extracted parameters 201*a* to 201*f* are shown in FIG. 16. Among the extracted parameters, the gain parameter 201*a*1 and the delay parameter 201*a*2 are used to synthesize a 'direct part'. Moreover, the dominant reflection component 201*d*, the model parameter 201*b* and the residual data 201*c* are used to synthesize an early reflection part respectively. In addition, the energy difference value 201*e* and the encoded data 201*f* are used to synthesize a late reverberation part.

First of all, the direct response generating unit 202 newly makes a response on a time axis by referring to the delay parameter 201*a*2 to reconstruct a direct part response. In doing so, a size of the response is applied with reference to the gain parameter 201*a*1.

Subsequently, the early reflection response generating unit 204 checks whether the residual data 201*c* was delivered together to reconstruct a response of the early reflection part. If the residual data 201*c* is included, it is added to the model parameter 201*b* (or a model coefficient), whereby $h_{er}(n)$ is reconstructed (203). This corresponds to the inverse process of Equation 3. On the contrary, if the residual data 201*c* does not exist, the dominant reflection component 201*d*, $ir_{er_dom}(n)$ is reconstructed by regarding the model parameter 201*b* as $h_{er}(n)$ (see Equation 2). In this regard, like the case of reconstructing the direct part response, the corresponding components may be reconstructed by referring to the delay 201*a*2 and the gain 201*a*1. As a last process for reconstructing the response of the early reflection part, the response is reconstructed using the input-output relation by referring to Equation 2. Namely, the final early reflection, $ir_{er}(n)$ can be reconstructed by performing convolution of the reflection response, $h_{er}(n)$ and the dominant component, $ir_{er_dom}(n)$.

Figure 17:
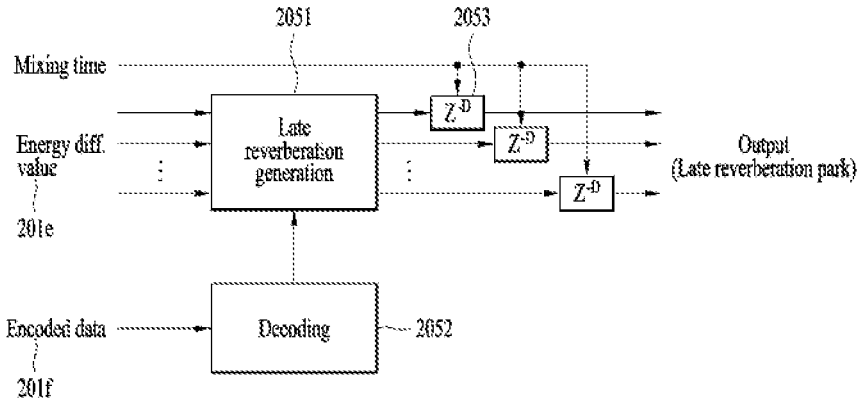
FIG. 17 is a block diagram showing a specific process of a late reverberation part generating unit 205 according to the present disclosure.

Finally, the late reverberation response generating unit 205 reconstructs a late reverberation part response using the energy difference value 201*e* and the encoded data 201*f*. A specific reconstruction process is described with reference to FIG. 17. First of all, the encoded data 201*f* reconstructs a downmix IR response using a decoder 2052 corresponding to the codec (1024*c* in FIG. 14) used for encoding. The late reverberation generating unit (late reverberation generation) 2051 reconstructs the late reverberation part by receiving inputs of the downmix IR response reconstructed through the decoder 2052, the energy difference value 201*e* and the mixing time. A specific process of the late reverberation generating unit 2051 is described as follows.

The downmix IR response reconstructed through the decoder 2052 is transformed into a time/frequency axis response, and a response size is changed by applying the energy difference value 201*e* calculated per frequency band for total M responses to the downmix IR. In this regard, Equation 6 in the following relates to a method of applying each of the energy difference values 201*e* to the downmix IR.

$$IR_{Late_m}(i,k)=\sqrt{D_{NRG_m}(b,k)}\cdot IR_{Late_dm}(i,k), \quad \text{[Equation 6]}$$

Equation 6 means that the energy difference value 201*e* is applied to all response coefficients belonging to a random band b. As Equation 6 is to apply the energy difference value 201*e* for each response to a downmixed late reverberation response, total M late reverberation responses are generated as the output of the late reverberation generating unit (late reverberation generation) 2051. Moreover, the late reverberation responses having the energy difference value 201*e* applied thereto are inverse-transformed into a time axis again. Thereafter, a delay 2053 is applied to the late reverberation response by applying the mixing time transmitted from an encoder (e.g., a transmitting end) together. The mixing time needs to be applied to the reconstructed late reverberation response so as to prevent responses from overlapping each other in a process for the respective responses to be combined together in FIG. 17.

If the aforementioned EDR is calculated as a feature parameter of the late reverberation response instead of the energy difference, the late reverberation response may be synthesized as follows. First of all, a white noise is generated by referring to the transmitted length information (Late reverb. Length). The generated signal is then transformed into a time/frequency axis. An energy value of a coefficient is transformed by applying EDR information to each time/frequency coefficient. The energy value applied white noise of the time/frequency axis is inverse-transformed into the time axis again. Finally, a delay is applied to the late reverberation response by referring to a mixing time.

In FIG. 16, the parts (direct part, early reflection part and late reverberation part) synthesized through the direct response generating unit 202, the early reflection response generating unit 204 and the reverberation response generating unit 205 are added by adders 206, respectively, and a final RIR information 206*a* is then reconstructed. If a separate HRIR information 201*g* fails to exist in a received bitstream (i.e., if RIR is included in the bitstream only), the reconstructed response is outputted intactly. On the contrary, If the separate HRIR information 201*g* exists in the received bitstream (i.e., if BRIR is included in the bitstream), a BRIR synthesizing unit 207 performs convolution on HRI corresponding to the reconstructed RIR response by Equation 7, thereby reconstructing a final BRIR response.

$$brir_{L_m}(n)=hrir_{L_m}(n)*rir_{L_m}(n)$$

$$brir_{R_m}(n)=hrir_{R_m}(n)*rir_{R_m}(n), m=1, \ldots, M \quad \text{[Equation7]}$$

In Equation 7, $brir_{L_m}(n)$ and $brir_{R_m}(n)$ are the informations obtained from performing convolutions of the reconstructed $rir_{L_m}(n)$ and $rir_{R_m}(n)$ and the $hrir_{L_m}(n)$ and $hrir_{R_m}(n)$, respectively. Moreover, the number of HRIRs is always equal to the number of the reconstructed RIRs.

Figure 18:
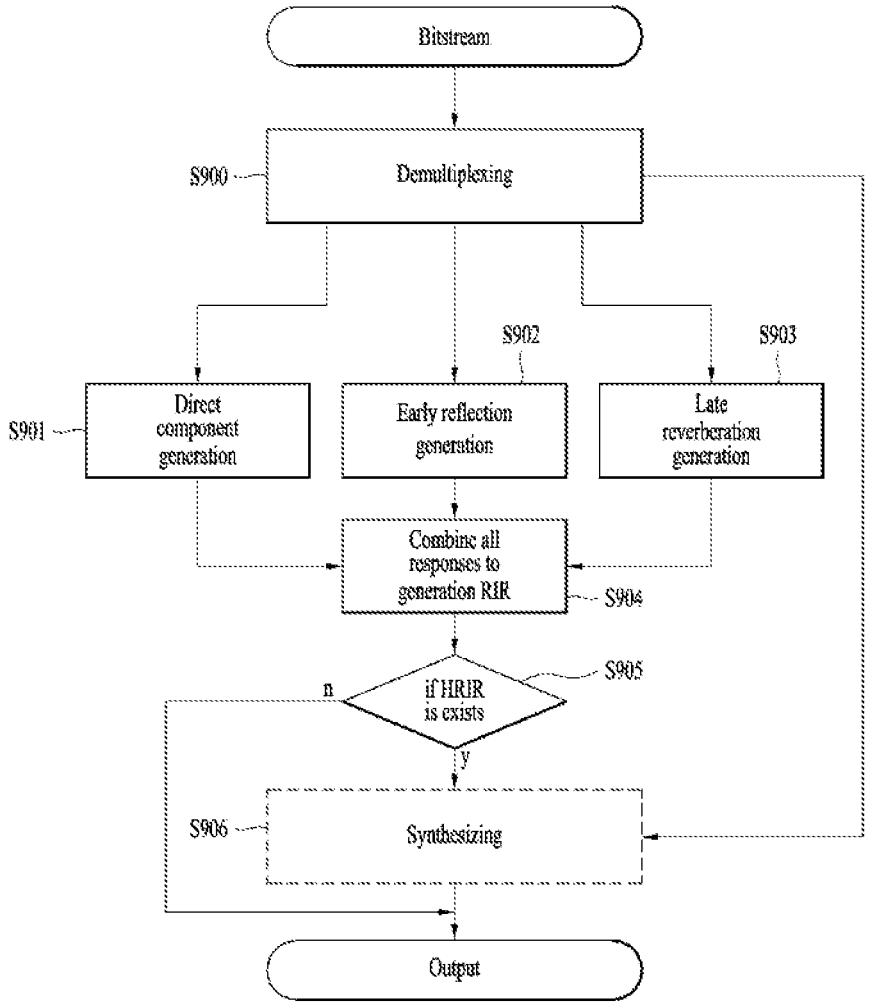
FIG. 18 is a flowchart of a process for synthesizing a BRIR/RIR parameter in an audio reproducing apparatus according to the present disclosure.

FIG. 18 is a flowchart of a process for synthesizing a BRIR/RIR parameter in an audio reproducing apparatus according to the present disclosure.

First of all, if a bitstream is received, a step S900 extracts all response informations by demultiplexing.

A step S901 synthesizes a direct part response using a gain and propagation time information corresponding to a direct part information. A step S902 synthesizes an early reflection part response using a gain and delay information of a dominant reflection component corresponding to an early reflection part information, a model parameter information of a transfer function and a residual information (optional). A step 903 synthesizes a late reverberation response using an energy difference value information and a downmixed late reverberation response information.

A step S904 synthesizes an RIR by adding all the responses synthesized in the steps S901 to S903. A step S905 checks whether an HRIR information is extracted from the input bitstream together (i.e., whether BRIR information is included in the bitstream). As a result of the check in the step S905, if the HRIR information is includes ('y' path), a BRIR is synthesized and outputted by performing convolution of an HRIR and the RIR generated from the step S904 through a step S906. On the contrary, if the HRIR information is not included in the input bitstream, the RIR generated from the step S904 is outputted as it is.

MODE FOR DISCLOSURE

Figure 19:
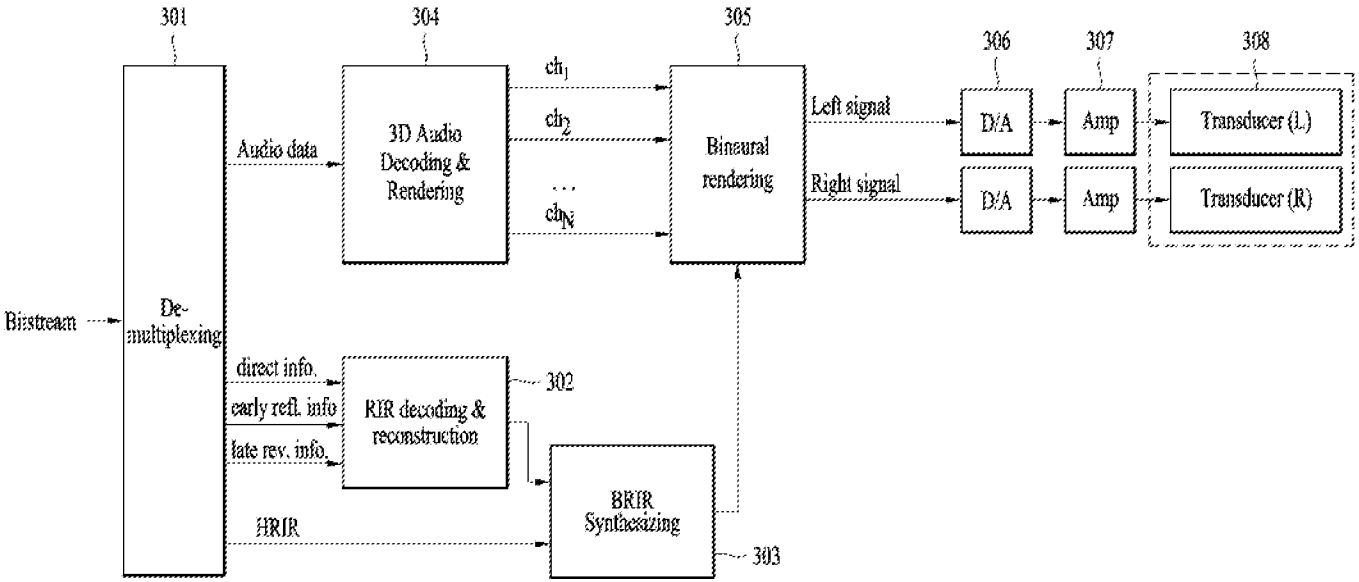
FIG. 19 is a diagram showing one example of an overall configuration of an audio reproducing apparatus according to the present disclosure.

FIG. 19 is a diagram showing one example of an overall configuration of an audio reproducing apparatus according to the present disclosure. If a bitstream is inputted, a demultiplexer (demultiplexing) 301 extracts an audio signal and informations for synthesizing a BRIR. Yet, although both of the audio signal (audio data) and the information related to the BRIR are assumed as included in a single bitstream for clarity of description, the audio signal and the BRIR related information may be transmitted on different bitstreams in a manner of being separated from each other for the practical use, respectively.

The parameterized direct information, early reflection information and late reverberation information among the extracted informations are the informations corresponding to a direct part, an early reflection part and a late reverberation part, respectively, and are inputted to an RIR reproducing unit (RIR decoding & reconstruction) 302 so as to generate an RIR by synthesizing and aggregating the respective response characteristics. Thereafter, through a BRIR synthesizing unit (BRIR synthesizing) 303, a separately extracted HRIR is synthesized with the RIR again, whereby a final BRIR inputted to a transmitting end is reconstructed. In this regard, as the RIR reproducing unit 302 and the BRIR synthesizing unit 303 have the same operations described with reference to FIG. 16, detailed description will be omitted.

The audio signal (audio data) extracted by the demultiplexer 301 performs decoding and rendering operations to fit a user's playback environment using an audio core decoder 302, e.g., '3D Audio Decoding & Rendering' 302, and outputs channel signals ($ch_1$, $ch_2$ . . . $ch_N$) as a result.

Moreover, in order for a 3D audio signal to be reproduced in a headphone environment, a binaural renderer (binaural rendering) 305 filters the channel signals with the BRIR synthesized by the BRIR synthesizing unit 303, thereby outputting left and right channel signals (left signal and right signal) having a surround effect. The left and right channel signals are reproduced to left and right tranducers (L) and (R) through digital-analog (D/A) converters 306 and signal amplifiers (Amps) 307, respectively.

Figure 20:
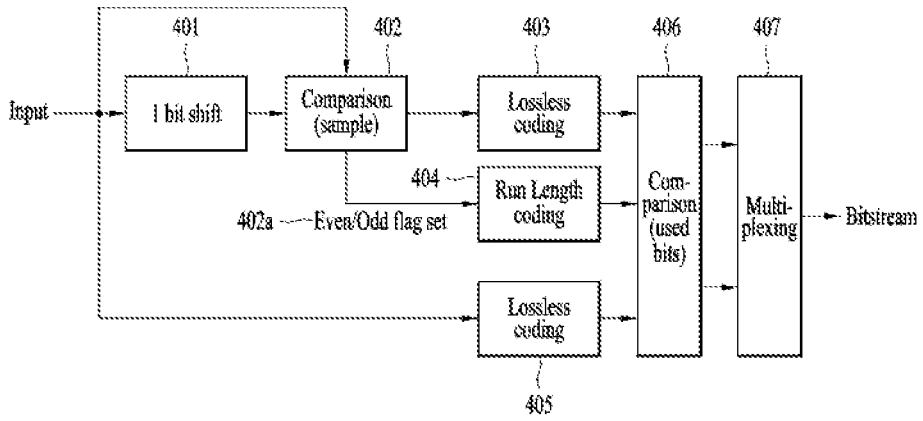
FIG. 20 and FIG. 21 are diagrams of examples of a lossless audio encoding method [FIG. 20] and a lossless audio decoding method [FIG. 21] applicable to the present disclosure.
Figure 21:
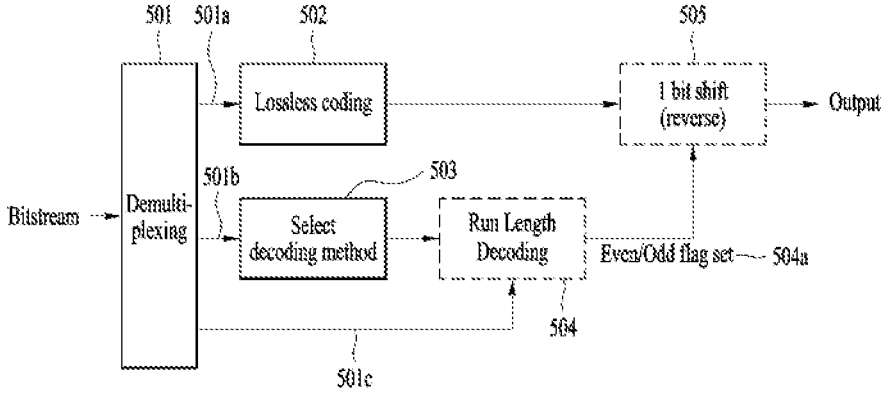

FIG. 20 and FIG. 21 are diagrams of examples of lossless audio encoding and decoding methods applicable to the present disclosure. In this regard, the encoding method shown in FIG. 20 is applicable before a bitstream output through the aforementioned multiplexer 103 of FIG. 3 or is applicable to the downmix signal encoding 1024*c* of FIG. 14. Yet, besides application to the embodiment of the present disclosure, it is apparent that the lossless encoding and decoding methods of the audio bitstream are applicable to various applied fields.

In case that BRIR/RIR information needs to be perfectly reconstructed in a BRIR/RIR transceiving process, it is necessary to use codec of a lossless coding scheme. Generally, lossless codec has bits consumed differently according to a size of an inputted signal. Namely, the smaller a size of a signal becomes, the less the bits consumed for compressing the corresponding signal get. Considering such matter, the present disclosure intentionally divides the inputted signal into two equal parts. This may be regarded as an effect of 1-bit shift in aspect of a digitally represented signal. Namely, if a signal number is even, no loss is generated. If a signal number is odd, a loss is generated (e.g., 4(0100) →2(010), 8(1000)→4(100), 3(0011)→1(001)). Therefore, in case of attempting to perform lossless coding on an input response using a 1-bit shift method according to the present disclosure, a process shown in FIG. 20 is performed.

First of all, referring to FIG. 20, a lossless encoding method of an audio bitstream according to the present disclosure includes two comparison blocks, e.g., 'Comparison (sample)' 402 and 'Comparison (used bits)' 406. The first 'Comparison (sample)' 402 compares a presence of identity of each inputted signal sample. For example, it is a process for checking whether a loss occurs from a value by applying 1-bit shift to an input sample. The second 'Comparison (used bits)' 406 compares amounts of used bits when encoding is performed in two ways. The lossless encoding method of the audio bitstream according to the present disclosure shown in FIG. 20 is described as follows.

First of all, if a response signal is inputted, 1-bit shift 401 is applied thereto. Subsequently, an original response is compared in sample unit through the 'Comparison (sample)' 402. If there is a change (i.e., a loss occurs), 'flag 1' is assigned. Otherwise, 'flag 0' is assigned. Thus, an 'even/odd flag set' 402*a* for an input signal is configured. A 1-bit shifted signal is used as an input of an existing lossless codec 403, and Run Length Coding (RLC) 404 is performed on the 'even/odd flag set' 402*a*. Finally, through the 'Comparison (used bits)' 406, the method encoded by the above procedure and the previously encoded method (e.g., a case of applying the lossless codec 405 to an input signal directly) are compared with each other from the perspective of a used bit amount. Then, an encoded method in a manner of consuming less bits is selected and stored in a bitstream. Hence, in order to reconstruct an original response signal in a decoder, a flag information (flag) for selecting one of the two encoding schemes needs to be used additionally. The flag information will be referred to as 'encoding method flag'. The encoded data and the 'encoding method flag' information are multiplexed by a multiplexer (multiplexing) 406 and then transmitted by being included in a bitstream.

FIG. 21 shows a decoding process corresponding to FIG. 20. If a response is encoded by the lossless coding scheme like FIG. 20, a receiving end should reconstruct a response through a lossless decoding scheme like FIG. 21.

If a bitstream is inputted, a demultiplexer (demultiplexing) 501 extracts the aforementioned 'encoded data' 501*a*, 'encoding method flag' 501*b* and 'run length coded data' 501*c* from the bitstream. Yet, as described above, the run length coded data 501*c* may not be delivered according to the aforementioned encoding scheme of FIG. 20.

The encoded data 501*a* is decoded using a lossless decoder 502 according to the existing scheme. A decoding mode selecting unit (select decoding method) 503 confirms an encoding scheme of the encoded data 501*a* by referring to the extracted encoding method flag 501*b*. If the encoder of FIG. 20 encodes an input response by 1-bit shift according to the scheme proposed by the present disclosure, informations of an even/odd flag set 504*a* are reconstructed using a run length decoder 504. Thereafter, the reconstructed flag informations may reconstruct the original response signal by reversely applying 1-bit shift to the response samples reconstructed through the lossless decoder 502 [505].

As described above, the lossless encoding/decoding method of the audio bitstream of the present disclosure according to FIG. 20 and FIG. 21 are applicable to encoding/decoding general audio signals variously by expanding an applicable range as well as to the aforementioned BRIR/RIR response signal.

INDUSTRIAL APPLICABILITY

The above-described present disclosure can be implemented in a program recorded medium as computer-readable codes. The computer-readable media may include all kinds of recording devices in which data readable by a computer system are stored. The computer-readable media may include ROM, RAM, CD-ROM, magnetic tapes, floppy discs, optical data storage devices, and the like for example and also include carrier-wave type implementations (e.g., transmission via Internet). Further, the computer may also include, in whole or in some configurations, the RIR parameter generating unit 102, the RIR reproducing unit 302, the BRIR synthesizing unit 303, the audio decoder & renderer 304, and the binaural renderer 305. Therefore, this description is intended to be illustrative, and not to limit the scope of the claims. Thus, it is intended that the present disclosure covers the modifications and variations of this disclosure provided they come within the scope of the appended claims and their equivalents.

What is claimed is:

1. A method of reproducing an audio, the method comprising:

demultiplexing audio data, Head-Related Impulse Response (HRIR) data, parameterized direct part-related information, parameterized early reflection part-related information, and parameterized late reverberation part-related information from a received audio bitstream;

reconstructing direct/early reflection parts based on the parameterized direct part-related information and the parameterized early reflection part-related information;

reconstructing late reverberation parts based on the parameterized late reverberation part-related information;

reconstructing Room Impulse Response (RIR) data by combining the direct/early reflection parts and the late reverberation parts based on a mixing time in the audio bitstream;

obtaining a Binaural Room Impulse Response (BRIR) data by synthesizing the reconstructed RIR data and the HRIR data;

decoding the audio data; and rendering the decoded audio data based on the BRIR data, wherein reconstructing late reverberation parts comprises:

decoding a representative late reverberation part in the late reverberation part-related information, wherein the representative late reverberation part is generated by downmixing the late reverberation parts in a transmitter, and reconstructing the late reverberation parts based on the decoded representative late reverberation part and energy difference information in the late reverberation part-related information, wherein the energy difference information is calculated by comparing energies of the representative late reverberation part and each of the late reverberation parts in the transmitter.

2. The method of claim 1, wherein the parameterized direct part-related information includes gain information and propagation time information extracted from the direct/early reflection parts.

3. The method of claim 1, wherein the parameterized early reflection part-related information includes a transfer function for an early reflection that is calculated based on gain information and delay information of a dominant reflection extracted from the direct/early reflection parts.

4. The method of claim 1, wherein the mixing time is information for indicating a timing point at which the late reverberation parts start on a time axis.

5. A method of processing an audio in a transmitter, the method comprising:

separating Binaural Room Impulse Response (BRIR) data into Room Impulse Response (RIR) data and Head-Related Impulse Response (HRIR) data;

extracting a mixing time from the RIR data;

separating the RIR data into direct/early reflection parts and late reverberation parts based on the mixing time;

parameterizing direct part related information from the separated direct/early reflection parts;

parameterizing nearly reflection part-related information from the separated direct/early reflection parts;

parameterizing late reverberation part-related information from the separate late reverberation parts; and transmitting an audio bitstream including the separated HRIR data, the parameterized direct part-related information, the parameterized early reflection part-related information, the parameterized late reverberation part-related information, and the mixing time, wherein parameterizing late reverberation part-related information comprises:

generating a representative late reverberation part by downmixing the separated late reverberation parts, encoding the generated representative late reverberation part, and parameterizing a calculated energy difference information by comparing energies of the representative late reverberation part and each of the late reverberation parts.

6. The method of claim 5, wherein the mixing time is information for indicating a timing point at which the late reverberation parts start on a time axis.

7. The method of claim 5, wherein parameterizing direct part-related information comprises:

extracting gain information and propagation time information related to a direct part from the direct/early reflection parts, and parameterizing the gain information and the propagation time information.

8. The method of claim 5, wherein parameterizing early reflection part-related information comprises:

extracting gain information and delay information related to a dominant reflection from the direct/early reflection parts, calculating a transfer function for an early reflection based on the gain information and the delay information related to the dominant reflection, and parameterizing the transfer function.

9. An apparatus for reproducing an audio, the apparatus comprising:

a demultiplexer to demultiplex audio data, Head-Related Impulse Response (HRIR) data, parameterized direct part-related information, parameterized early reflection part-related information, and parameterized late reverberation part-related information from a received audio bitstream;

an RIR reproducing unit to reconstruct direct/early reflection parts based on the parameterized direct part-related information and the parameterized early reflection part-related information, to reconstruct late reverberation parts based on the parameterized late reverberation part-related information, and reconstruct Room Impulse Response (RIR) data by combining the direct/early reflection parts and the late reverberation parts based on a mixing time in the audio bitstream;

a BRIR synthesizing unit to obtain Binaural Room Impulse Response (BRIR) data by synthesizing the reconstructed RIR data and the HRIR data;

an audio core decoder to decode the audio data; and a binaural renderer to render the decoded audio data based on the BRIR data, wherein the RIR reproducing unit decodes a representative late reverberation part in the late reverberation part-related information and reconstructs the late reverberation parts based on the decoded representative late reverberation part and energy difference information in the late reverberation part-related information, wherein the representative late reverberation part is generated by downmixing the late reverberation parts in a transmitter, and wherein the energy difference information is calculated by comparing energies of the representative late reverberation part and each of the late reverberation parts in the transmitter.

10. The apparatus of claim 9, wherein the parameterized direct part-related information includes gain information and propagation time information extracted from the direct/early reflection parts.

11. The apparatus of claim 9, wherein the early reflection part-related information includes a transfer function for an early reflection that is calculated based on gain information and delay information of a dominant reflection extracted from the direct/early reflection parts.

12. The apparatus of claim 9, wherein the mixing time is information for indicating a timing point at which the late reverberation parts start on a time axis.

13. A transmitter for processing an audio, the transmitter comprising:

a decomposition unit to separate Binaural Room Impulse Response (BRIR) data into Room Impulse Response (RIR) data and Head-Related Impulse Response (HRIR) data;

a mixing time extractor to extract a mixing time from the RIR data;

a separator to separate the RIR data into direct/early reflection parts and late reverberation parts based on the mixing time;

a first parameter generator to parameterize direct part-related information from the separated direct/early reflection parts;

a second parameter generator to parameterize early reflection part-related information from the separated direct/early reflection parts;

a third parameter generator to parameterize late reverberation part-related information from the separate late reverberation parts; and a multiplexer to transmit an audio bitstream including the separated HRIR data, the parameterized direct part-related information, the parameterized early reflection part-related information, the parameterized late reverberation part-related information, and the mixing time, wherein the third parameter generator comprises:

a downmixer to generate a representative late reverberation part by downmixing the separated late reverberation parts, an encoder to encode the generated representative late reverberation part, and a calculator to parameterize a calculated energy difference information by comparing energies of the representative late reverberation part and each of the late reverberation parts.

14. The transmitter of claim 13, wherein the mixing time is information for indicating a timing point at which the late reverberation parts start on a time axis.

15. The transmitter of claim 13, wherein the first parameter generator extracts gain information and propagation time information related to a direct part from the direct/early reflection parts and parameterizes the gain information and the propagation time information.

16. The transmitter of claim 13, wherein the second parameter generator extracts gain information and delay information related to a dominant reflection from the direct/early reflection parts, calculates a transfer function for an early reflection based on the gain information and the delay information related to the dominant reflection, and parameterizes the transfer function.

* * * * *